US011250739B2

(12) United States Patent
Pan

(10) Patent No.: US 11,250,739 B2
(45) Date of Patent: Feb. 15, 2022

(54) PORTABLE CYLINDRICAL LIGHT BOX

(71) Applicant: Guojun Pan, Shanghai (CN)

(72) Inventor: Guojun Pan, Shanghai (CN)

( * ) Notice: Subject to any disclaimer, the term of this patent is extended or adjusted under 35 U.S.C. 154(b) by 222 days.

(21) Appl. No.: 16/667,915

(22) Filed: Oct. 30, 2019

(65) Prior Publication Data

US 2021/0134193 A1 May 6, 2021

(51) Int. Cl.

| | |
|---|---|
| ***G09F 13/04*** | (2006.01) |
| ***F21V 21/00*** | (2006.01) |
| ***G09F 13/22*** | (2006.01) |
| ***G09F 13/10*** | (2006.01) |
| *F21Y 103/10* | (2016.01) |
| *F21Y 115/10* | (2016.01) |

(52) U.S. Cl.

CPC ..... *G09F 13/0413* (2013.01); *F21V 21/00* (2013.01); *G09F 13/10* (2013.01); *G09F 13/22* (2013.01); *F21Y 2103/10* (2016.08); *F21Y 2115/10* (2016.08); *G09F 13/0463* (2021.05); *G09F 13/0481* (2021.05); *G09F 2013/222* (2013.01)

(58) Field of Classification Search

CPC ..... G09F 13/0413; G09F 13/10; G09F 2013/222; G09F 13/0463; G09F 13/0481; F21V 21/00

See application file for complete search history.

(56) References Cited

U.S. PATENT DOCUMENTS

| | | | | |
|---|---|---|---|---|
| 10,573,206 | B1 * | 2/2020 | Canaphany | G09F 13/0404 |
| 10,697,621 | B1 * | 6/2020 | Zolte | E04H 12/32 |
| 2012/0239521 | A1 * | 9/2012 | Acworth | F21S 8/06 705/26.5 |
| 2014/0049972 | A1 * | 2/2014 | McGuire | F21K 9/23 362/427 |
| 2016/0018076 | A1 * | 1/2016 | Santiago | F21S 4/10 362/310 |
| 2018/0047319 | A1 * | 2/2018 | Barba | G03B 21/10 |
| 2019/0096293 | A1 * | 3/2019 | Kwon | F21V 9/40 |
| 2019/0266929 | A1 * | 8/2019 | Beille | G09F 13/0413 |
| 2019/0278095 | A1 * | 9/2019 | Pan | F21V 17/007 |
| 2019/0293266 | A1 * | 9/2019 | Anderson | G09F 13/0468 |
| 2020/0032982 | A1 * | 1/2020 | Bastian | F21V 3/023 |
| 2020/0185938 | A1 * | 6/2020 | Pan | G09F 13/0445 |
| 2021/0074190 | A1 * | 3/2021 | Murray | G09F 7/04 |
| 2021/0164639 | A1 * | 6/2021 | Choi | F21V 29/70 |

* cited by examiner

*Primary Examiner* — Gary C Hoge

(57) ABSTRACT

A portable cylindrical light box, including a strut, an advertising fabric, a fixed profile and a transparent film. An inner wall of the advertising fabric is sewn with a first silicone strip. An outer wall of the first silicone strip abuts the transparent film. A second silicone strip is adhered to the bending portion of an outer wall of the transparent film. The groove is provided on the strut. An outer wall of the fixed profile is fixed with a light bar including an adhesive layer, a soft base layer adhesively connected to the fixed profile by the adhesive layer, and an LED bead SMD fixed on the soft base layer. The upper and lower ends of the fixed profile are respectively mounted with a bottom plate assembly and a cover plate assembly fixedly connected to the upper end of the fixed profile by screws.

6 Claims, 14 Drawing Sheets

PORTABLE CYLINDRICAL LIGHT BOX

TECHNICAL FILED

The present disclosure relates to the technical field of light boxes, in particular to a portable cylindrical light box.

BACKGROUND

Light boxes, as the term suggests, are lamps used for lighting. With the development of technology, light boxes are becoming more and more practical. At present, the existing light boxes are inconvenient to carry, the lighting effect is not good, and the shadow of the picture is large when the installation is without the use of the frameless installation, which can not meet the requirements in actual use. Therefore, there is an urgent demand for improved technology to improve this device on the market.

SUMMARY

(1) Technical Problems to be Solved

In view of the deficiencies of the prior art, a portable cylindrical light box is provided by the present disclosure to solve the problems raised in the above background art.

(2) Technical Solution

In order to achieve the above object, the present disclosure provided a technical solution as following: A portable cylindrical light box, comprising a strut, a advertising fabric, a fixed profile and a transparent film, wherein an inner wall of the advertising fabric is sewn a first silicone strip, an outer wall of the first silicone strip is abuttingly connected to the transparent film, a second silicone strip is adhered to a bending portion of an outer wall of the transparent film, a groove is provided on the strut, and an outer wall of the fixed profile is fixed with a light bar.

Preferably, a cover plate assembly and a bottom plate assembly are respectively mounted on an upper end and a lower end of the fixed profile, and the cover plate assembly is fixedly connected to the upper end of the fixed profile by screw, and the bottom plate assembly is fixed connected to the lower end of the fixed profile by screw.

Preferably, the light bar comprises an LED bead SMD (surface-mounted diode), a soft base layer and an adhesive layer, and the LED bead SMD is fixed on the soft base layer.

Preferably, the soft base layer is adhesively connected to the fixed profile by the adhesive layer.

Preferably, the strut is snap-fitted to the second silicone strip at the bending portion of the transparent film through a groove.

Preferably, the strut is snap-fitted to the first silicone strip on the advertising fabric through a groove.

(3) Advantageous Effect

The present disclosure provides a portable cylindrical light box, which has the following advantageous effects:

(1) The present disclosure solves the problem that the inconvenient carrying and poor lighting effect by setting the fixed profile, the transparent film and the light bar. The fixed profile of the present disclosure is provided with a plurality of light bars attached thereto, which can illuminate the surroundings. The light bars are attached to the fixed profile by the adhesive layer, which has the advantages of convenient installation and uniform brightness of the whole screen. Further, in order to eliminate the problem of the concave shape of the advertising fabric of the cylindrical light box, a highly transparent film is added on the inner side of the advertising fabric. The high transparency is to ensure that the brightness of the light is not affected, and the curvature of the transparent film ensures that the picture is flat, so that the appearance of the light box is beautiful, and the present disclosure has a cylindrical shape with a small size, and is convenient to carry.

(2) The present disclosure solves the problem that the large shadow of the screen caused by the non-frameless installation is used when the light box is installed by setting the struts, the first silicone strip and the second silicone strip, and the present disclosure first uses the second silicone strip to fixed on the bending side of the transparent film by glue, and then the transparent film is stuck in the groove of the strut. At this time, the second silicone strip on the transparent film is located at the innermost side of the groove and the second silicone strip cooperates with the groove to fix the transparent film on the strut. The gap in the upper half of the second silicone strip on the transparent film is used for installing the advertising fabric, so that the transparent film and the advertising fabric are fixed in the same slot, so as to achieve the effect of non-frameless installation, reducing the shadow on the screen to the extreme value.

Figure 1:
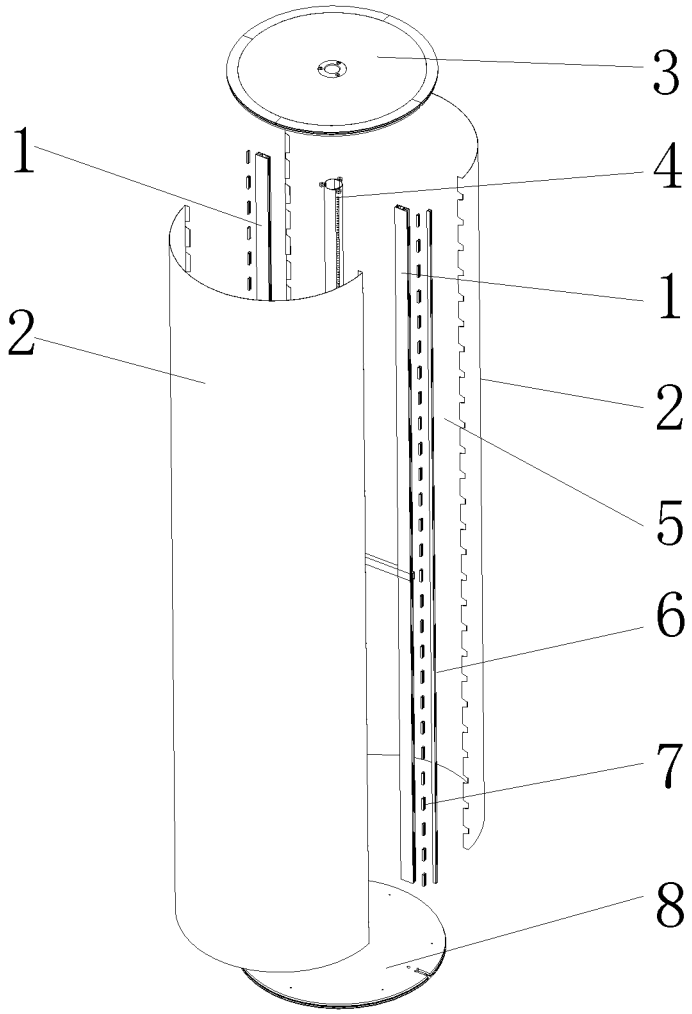
FIG. 1 is a schematic view showing the structure of the present disclosure.

The reference numerals in the Figure are referred as following: 1, strut; 2, advertising fabric; 3, cover plate assembly; 4, fixed profile; 5, transparent film; 6, first silicone strip; 7, second silicone strip; 8, bottom plate assembly; 9, screw; 10, light bar; 11, LED bead SMD; 12, soft base layer; 13, adhesive layer; 14, groove.

DETAILED DESCRIPTION OF THE EMBODIMENTS

The technical solutions in the embodiments of the present disclosure will be clearly and completely described in conjunction with the drawings in the embodiments of the present disclosure. It is obvious that the described embodiments are only a part of the embodiments of the present disclosure, and not all of the embodiments. All other embodiments obtained by those skilled in the art based on the embodiments of the present disclosure without creative efforts are within the scope of the present disclosure.

Figure 2:
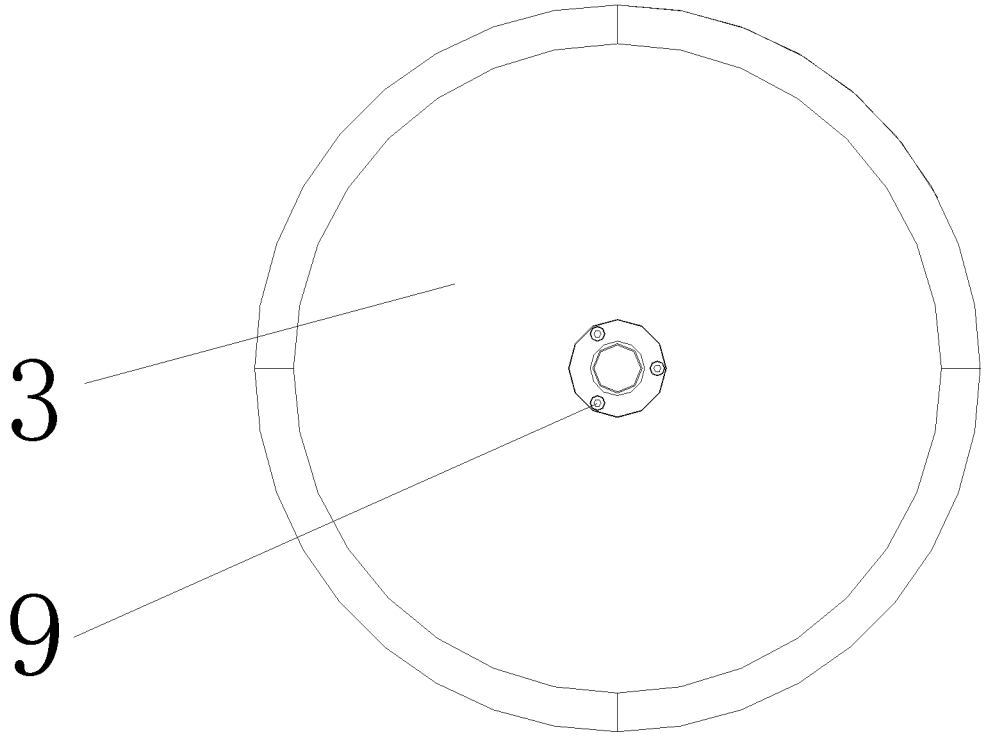
FIG. 2 is a schematic structural view of the cover plate assembly of FIG. 1 of the present disclosure.
Figure 3:
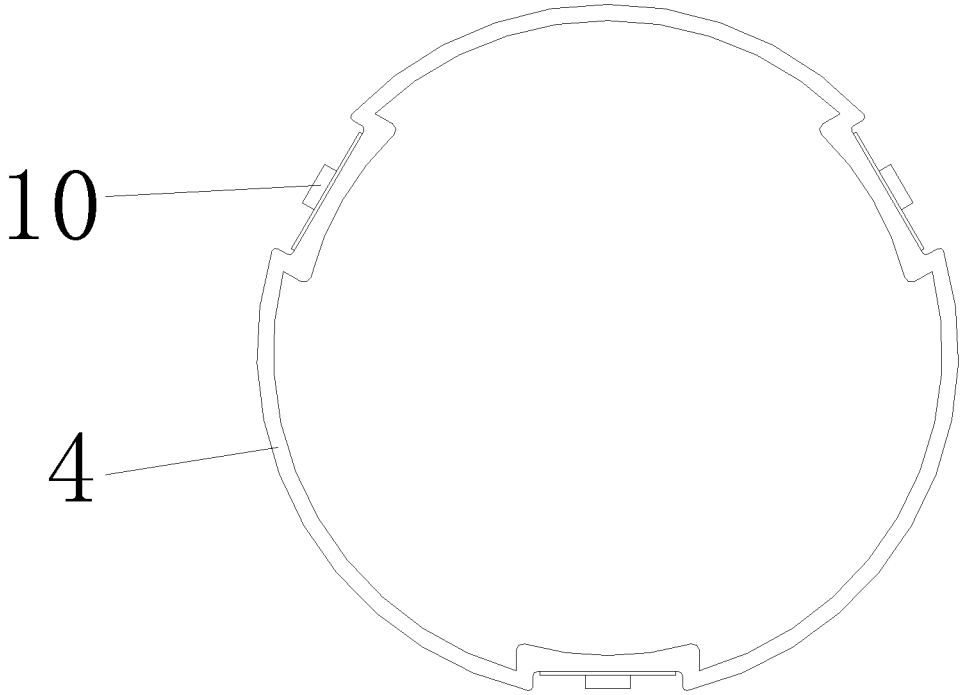
FIG. 3 is a schematic structural view of the fixed profile of FIG. 1 of the present disclosure.
Figure 4:
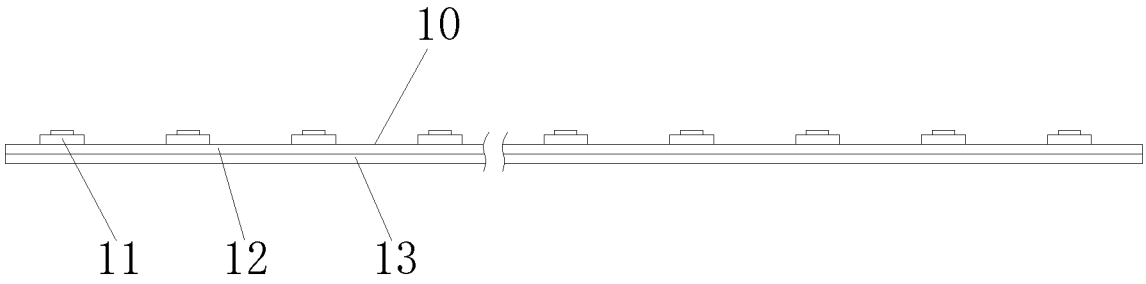
FIG. 4 is a schematic structural view of the light bar of FIG. 3 of the present disclosure.
Figure 5:
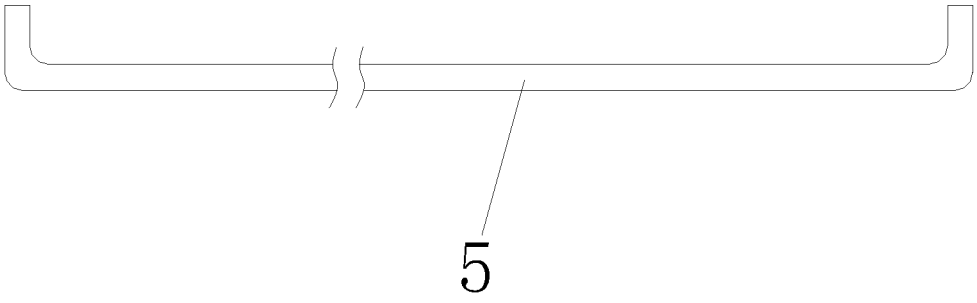
FIG. 5 is a schematic structural view of the transparent film of FIG. 1 of the present disclosure.
Figure 6:
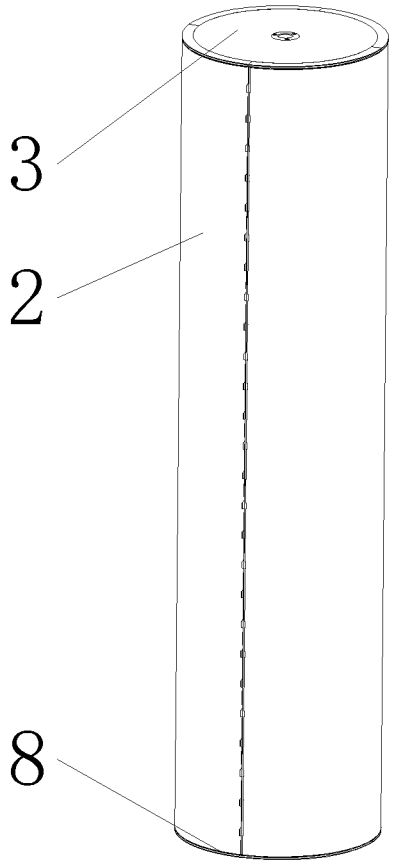
FIG. 6 is a schematic view of an appearance of the present disclosure.
Figure 7:
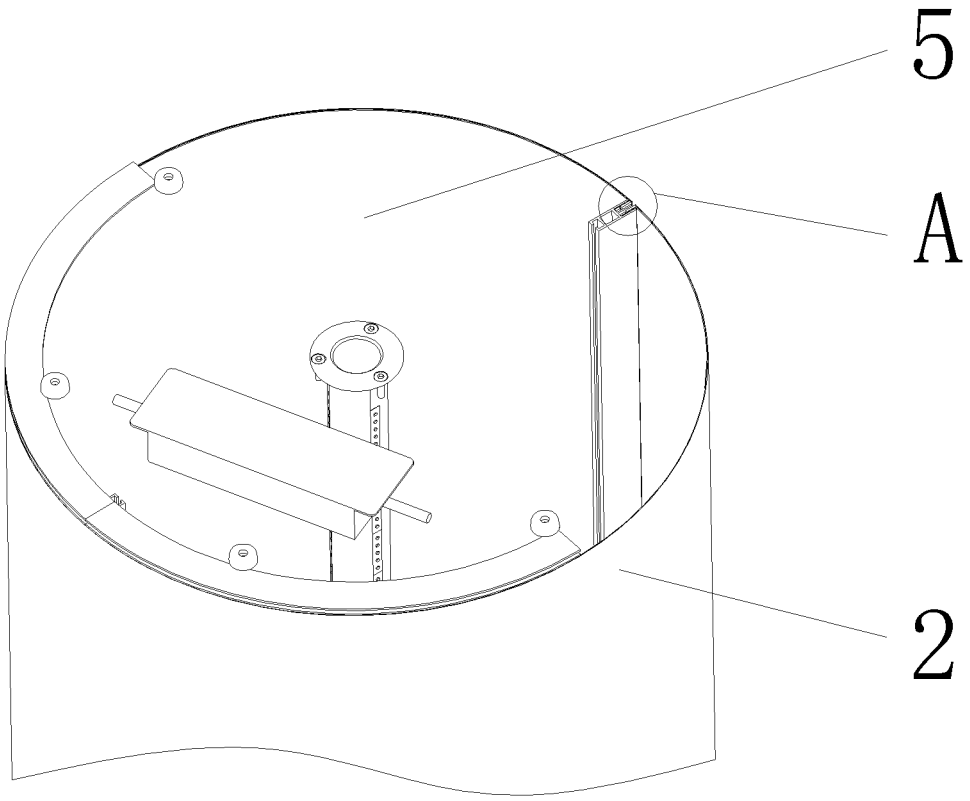
FIG. 7 is a schematic view showing the connection of the transparent film and the advertising fabric and the strut of FIG. 1 of the present disclosure.
Figure 8:
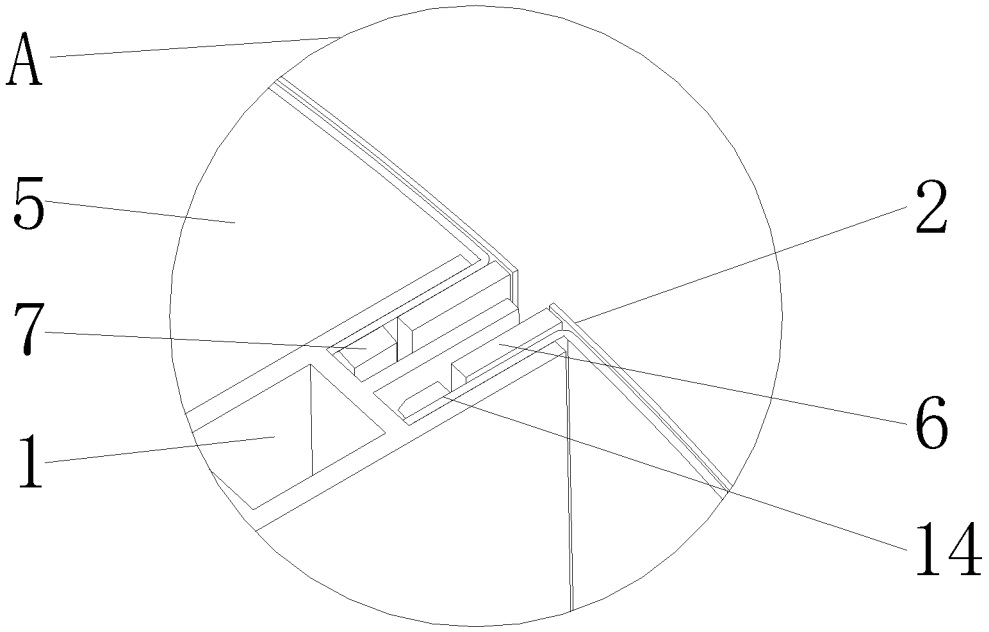
FIG. 8 is an enlarged view showing the structure of the portion A of FIG. 7 of the present disclosure.
Figure 9:
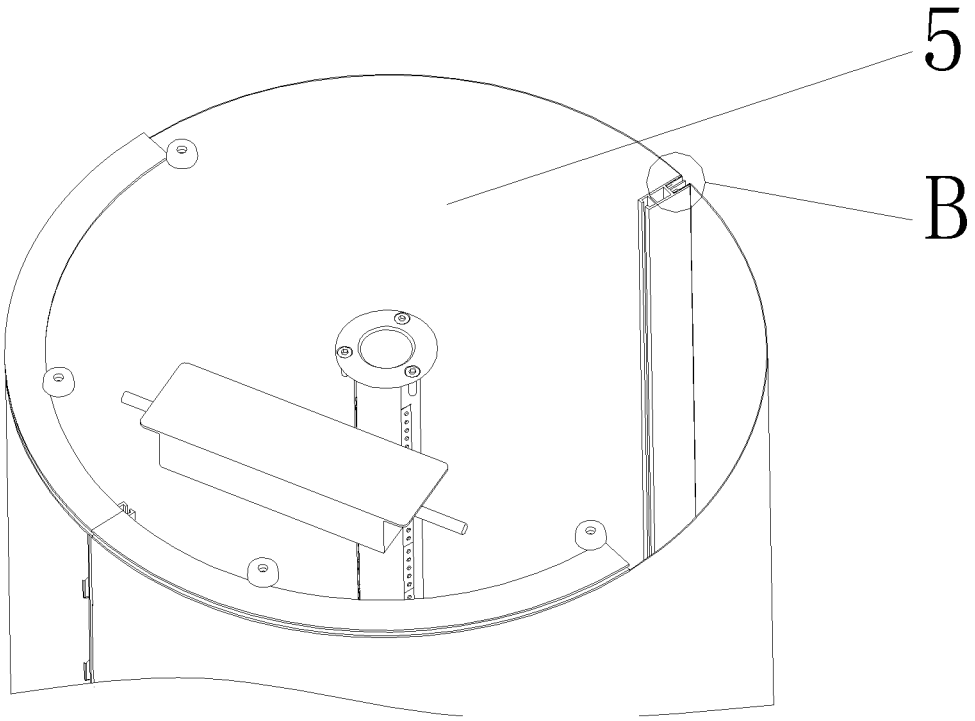
FIG. 9 is a schematic view showing the connection of the transparent film and the strut of FIG. 1 of the present disclosure.
Figure 10:
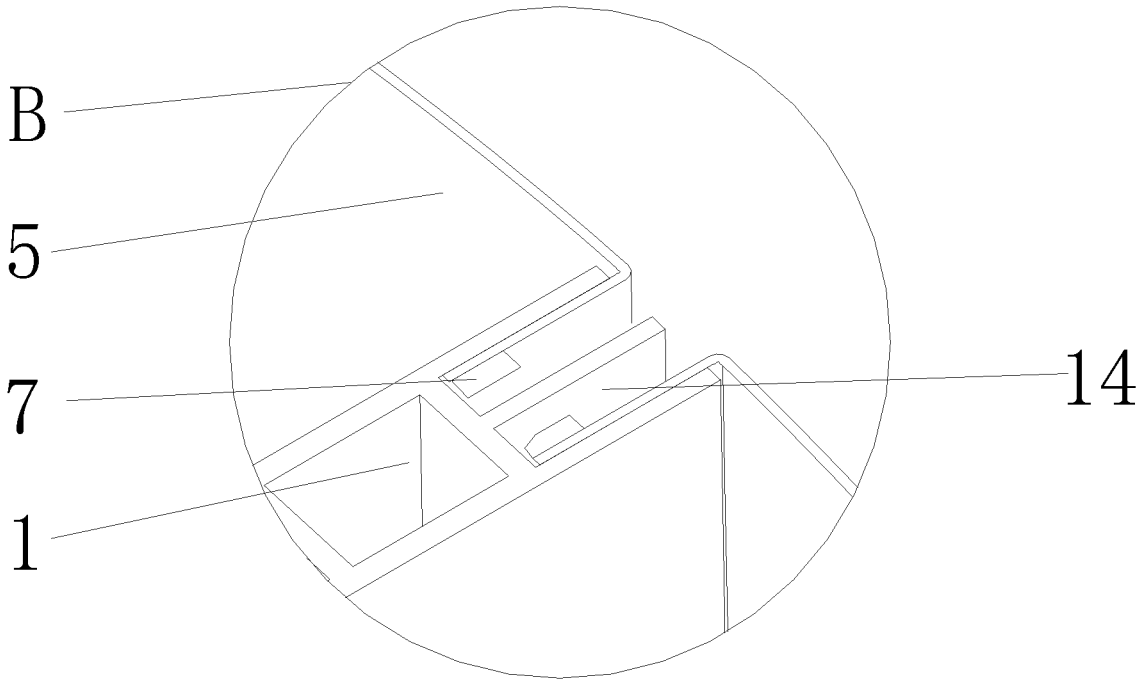
FIG. 10 is an enlarged view showing the structure of the portion B of FIG. 9 of the present disclosure.
Figure 11:
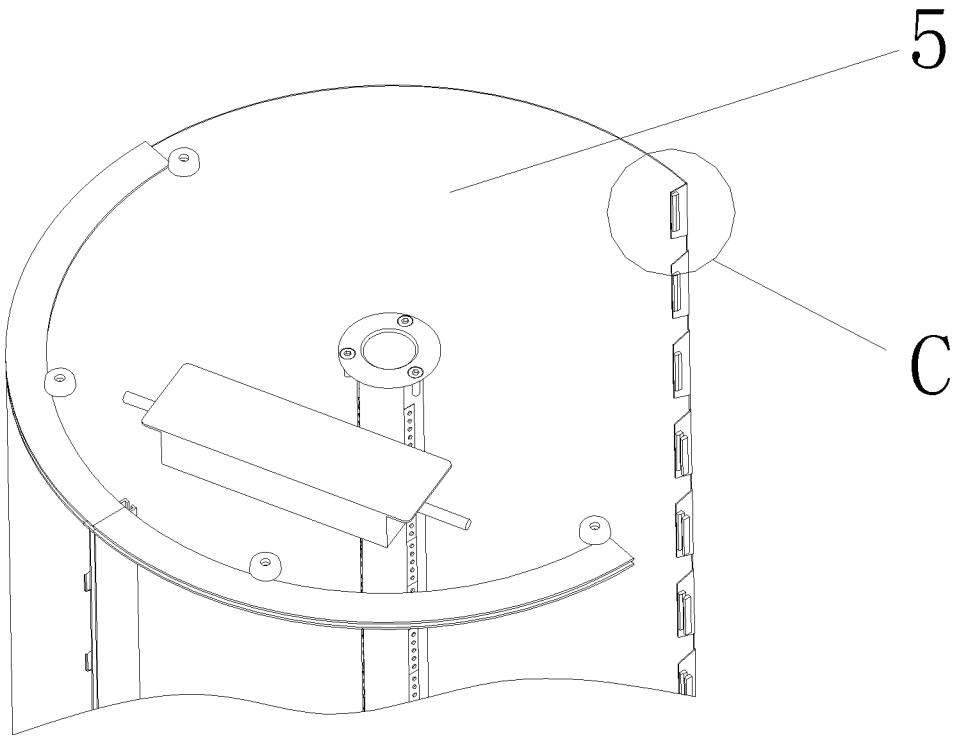
FIG. 11 is a schematic view showing the connection of the transparent film of FIG. 1 and the second silica gel strip of the present disclosure.
Figure 12:
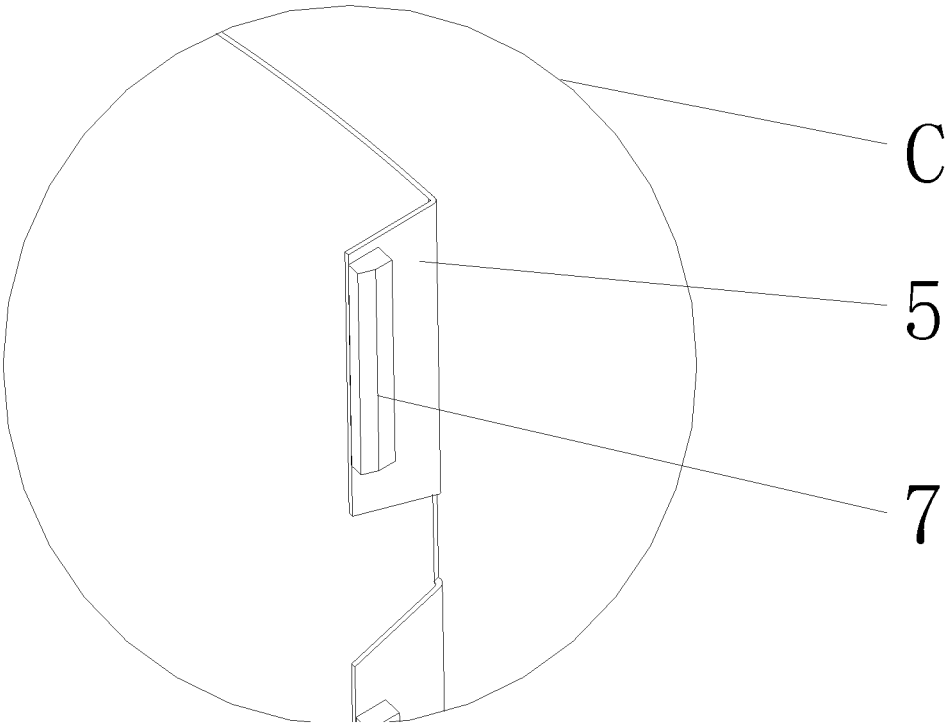
FIG. 12 is an enlarged view of the structure of the portion C of FIG. 11 of the present disclosure.
Figure 13:
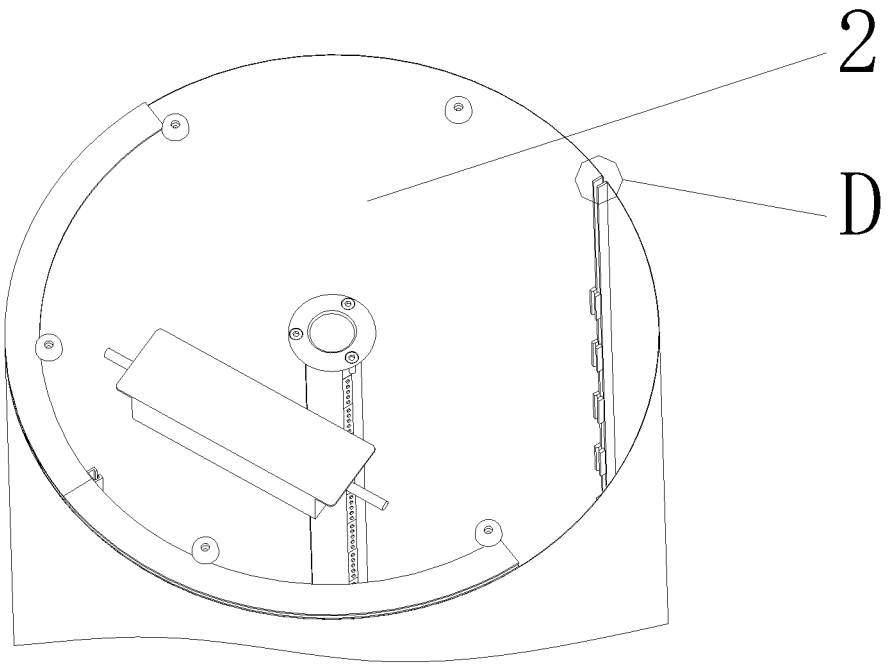
FIG. 13 is a schematic view showing the connection between the advertising fabric of FIG. 1 and the first silicone strip of the present disclosure.
Figure 14:
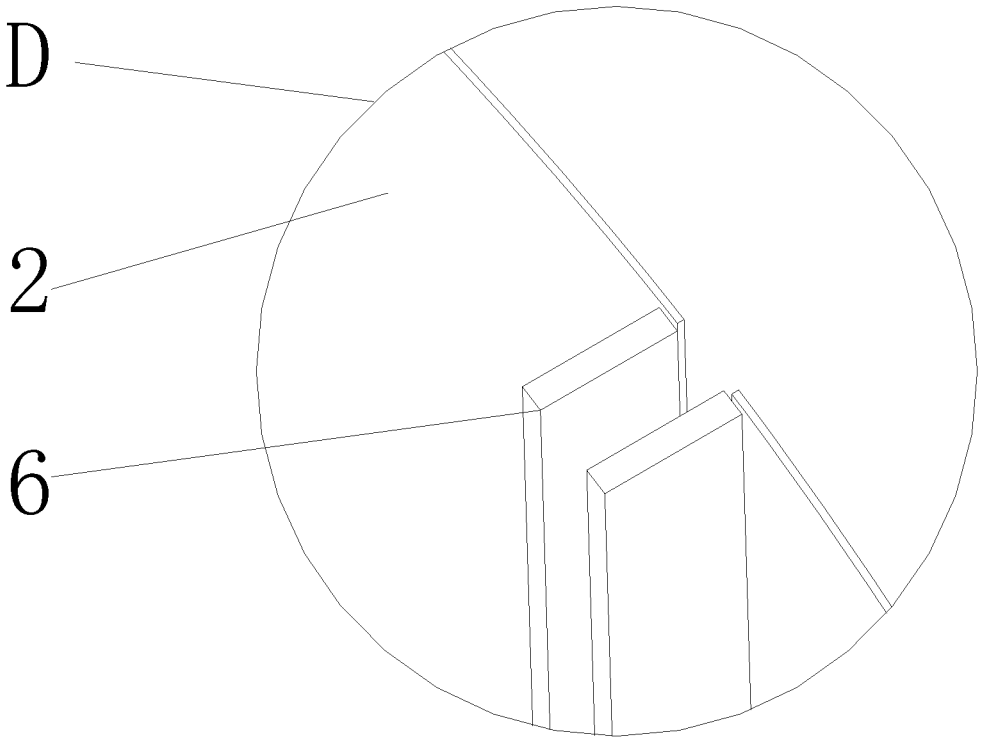
FIG. 14 is an enlarged view of the structure of the portion D of FIG. 13 of the present disclosure.

As shown in FIG. 1-14, the present disclosure provides a technical solution: a portable cylindrical light box, including a strut 1, a advertising fabric 2, a fixed profile 4, and a transparent film 5. In order to eliminate the problem that the light box screen is concave inward, a high-transparency transparent film 5 with a thickness of 0.80 mm is additionally installed on the inner side of the light box screen. The high transparency is to ensure that the brightness of the light is not affected, and the curvature of the transparent film 5 ensures that the picture is flat, so that the appearance of the light box is beautiful. The inner wall of the advertising fabric 2 is sewn with the first silicone strip 6, and the outer wall of the first silicone strip 6 is abuttingly connected to the transparent film 5, and the transparent film 5 is mounted on the inner side of the light box screen to ensure that the light box screen is flat. A second silicone strip 7 is adhered to the bending portion of the outer wall of the transparent film 5, and a groove 14 is provided on the strut 1. The outer wall of the fixed profile 4 is fixed with a light bar 10. And the fixed section 4 is made by extruding of high quality aluminum AL6063-T5. There are three slots on the profile for installing the light bar 10, and the light bar 10 is flush with the profile after the light bar 10 is installed.

Further, the upper and lower ends of the fixed profile 4 are respectively installed with the cover plate assembly 3 and the bottom plate assembly 8, and the cover plate assembly 3 is fixed to the upper end of the fixed profile 4 through the screw 9. The bottom plate assembly 8 is fixed to the lower end of the fixed profile 4 through the screw 9. The cover plate assembly 3 and the bottom plate assembly 8 are connected with the screw 9, which is not easy to install and fix.

Further, the light bar 10 includes LED bead SMD 11, soft base layer 12 and an adhesive layer 13, and the LED bead SMD 11 is fixed on the soft base layer 12. The light bar 10 uses high brightness LED beads with high brightness.

Further, the soft base layer 12 is adhesively connected to the fixed profile 4 by the adhesive layer 13. The soft base layer 12 is provided with the adhesive layer 13, such that the soft base layer 12 is easy to be fixed on fixed profile 4, and the three sides of the soft base layer are lighted, so as to make the brightness uniform of the picture screen.

Further, the strut 1 is snap-fitted to the second silicone strip 7 at the bending portion of the transparent film 5 through a groove 14. The two sides of the transparent film 5 are bent, so that the transparent film 5 is easy to be fixed on the strut 1.

Further, the strut 1 is snap-fitted to the first silicone strip 6 on the advertising fabric 2 through a groove 14.

Work principle: The second silicone strip 7 is fixed on the bending side of the transparent film 5 with glue when used (refer to FIG. 12), and then the transparent film 5 is stuck in the groove 14 of the strut 1 (refer to FIG. 10). At this time, the second silicone strip 7 on the transparent film 5 is located at the innermost of the groove 14, and the transparent film 5 is fixed on the strut 1 by the cooperating of the second silicone strip 7 and the groove 14. After then, the first silicone strip 6 is sewn on the advertising fabric 2 (refer to FIG. 14), and the first silicone strip 6 is stuck in the groove 14 of the strut 1 (refer to FIG. 8), so that the transparent film 5 and the cloth screen 2 are fixed at the same time in the same groove. Then the light bar 10 is attached to the fixed profile 4 (refer to FIG. 3) through the adhesive layer 13. The cover plate assembly 3 and the bottom plate assembly 8 are fixed by screws (9).

As above, the present disclosure solves the problem that the inconvenient portability, poor lighting effect and the shadow of the picture caused by the installation without the use of the frameless installation by setting the strut 1, the fixed profile 4, the transparent film 5, the first silicone strip 6, the second silicone strip 7 and the light strip 10.

It should be noted that, in this context, relational terms such as "first" and "second" are used merely to distinguish one entity or operation from another entity or operation, and do not necessarily require or imply any such actual relationship or order between the entities or operations. Furthermore, the term "comprising" or "comprises" or any other variations thereof is intended to encompass a non-exclusive inclusion, such that a process, method, article, or device that comprises a plurality of elements includes not only those elements but also includes other elements not explicitly listed, or elements that are inherent to such a process, method, item, or device.

While the embodiments of the present disclosure have been shown and described, it should be understood that various changes, modifications, substitutions and transformations, which are made without departing from the principle and spirit of the present disclosure, can be performed on the embodiments of the present disclosure, which are within the scope of the present disclosure as defined by the appended claims.

What is claimed is:

1. A portable cylindrical light box, comprising a strut (1), an advertising fabric (2), a fixed profile (4) and a transparent film (5), wherein an inner wall of the advertising fabric (2) is sewn to a first silicone strip (6), an outer wall of the first silicone strip (6) is abutted on the transparent film (5), a second silicone strip (7) is adhered to a bending portion of an outer wall of the transparent film (5), a groove (14) is provided on the strut (1), and an outer wall of the fixed profile (4) is fixed with a light bar (10).

2. The portable cylindrical light box according to claim 1, wherein a cover plate assembly (3) and a bottom plate assembly (8) are respectively mounted on an upper end and a lower end of the fixed profile (4); the cover plate assembly (3) is fixedly connected to the upper end of the fixed profile (4) by screw (9), and the bottom plate assembly (8) is fixed connected to the lower end of the fixed profile (4) by a screw (9).

3. The portable cylindrical light box according to claim 1, wherein the light bar (10) comprises an LED bead SMD (11), a soft base layer (12) and an adhesive layer (13), and the LED bead SMD (11) is fixed on the soft base layer (12).

4. The portable cylindrical light box according to claim 3, wherein the soft base layer (12) is adhesively connected to the fixed profile (4) by the adhesive layer (13).

5. The portable cylindrical light box according to claim 1, wherein the strut (1) is in a friction fit with the second silicone strip (7) at the bending portion of the transparent film (5) through a groove.

6. The portable cylindrical light box according to claim 1, wherein the strut (1) is in a friction fit with the first silicone strip (6) on the advertising fabric (2) through the groove (14).

* * * * *